US005280157A

United States Patent [19]

Hornung

[11] Patent Number: 5,280,157

[45] Date of Patent: Jan. 18, 1994

[54] POWER SWITCHING ARRANGEMENT FOR COOKING OVEN

[75] Inventor: Richard E. Hornung, Louisville, Ky.

[73] Assignee: General Electric Company, Louisville, Ky.

[21] Appl. No.: 829,748

[22] Filed: Jan. 31, 1992

[51] Int. Cl.[5] ..... A21B 1/00; F27D 11/00; H05B 3/02

[52] U.S. Cl. ..... 219/397; 219/398; 219/508

[58] Field of Search ..... 219/395, 396, 397, 398, 219/408, 412, 413, 508, 509, 400, 401

[56] References Cited

U.S. PATENT DOCUMENTS

| | | | |
|---|---|---|---|
| 2,055,246 | 9/1936 | Bradbury . | |
| 2,483,866 | 10/1949 | Ziola . | |
| 3,032,636 | 5/1962 | Schauer | 219/412 |
| 3,041,440 | 6/1962 | Dills | 219/395 |
| 3,214,567 | 10/1965 | Chisholm | 219/395 |
| 3,257,544 | 6/1966 | Benjamin, Jr. | 219/486 |
| 3,364,338 | 1/1968 | Holtkamp | 219/398 |
| 3,549,862 | 12/1970 | Holtkamp | 219/482 |
| 3,619,564 | 11/1971 | Schauer | 219/413 |
| 3,668,371 | 6/1972 | Fry | 219/413 |
| 4,316,079 | 2/1982 | Schmitz | 219/413 |
| 4,493,976 | 1/1985 | Wilson | 219/398 |
| 4,623,781 | 11/1986 | Thomas | 219/413 |
| 4,634,842 | 1/1987 | Payne | 219/486 |
| 4,912,300 | 3/1990 | Hennuy et al. | 219/364 |

*Primary Examiner*—Bruce A. Reynolds
*Assistant Examiner*—John A. Jeffery
*Attorney, Agent, or Firm*—H. Neil Houser; Radford M. Reams

[57] ABSTRACT

A power switching arrangement for a self-cleaning oven appliance incorporating a unique arrangement of two double throw relays in the oven power control circuit. The two relays are operatively interconnected to selectively couple the oven bake and broil elements to the three wire power supply to switch the bake element across L1 and L2 and the broil element across L1 and N when operating in the bake mode, and switch the bake element out of the circuit and the broil element across L1 and L2, when operating in the broil mode. The interconnection is accomplished in a manner which prevents both heating elements from being simultaneously energized at full power regardless of the failure mode of the switching circuitry, thereby eliminating the need for a thermal limit switch to guard against excessive temperatures in the oven resulting from worst case switching circuit failures.

4 Claims, 2 Drawing Sheets

POWER SWITCHING ARRANGEMENT FOR COOKING OVEN

BACKGROUND OF THE INVENTION

This invention relates to electric self-cleaning cooking ovens and more particularly to power control relay switching circuits for such ovens.

Electric self-cleaning ovens are typically provided with a broil heating element disposed proximate the top wall of the oven and a bake element disposed proximate the bottom wall of the oven. A typical relay switching circuit known in the art for controlling energization of these elements is illustrated in FIG. 1. In this circuit, relay contacts 1 and 2 switchably electrically connect one terminal of the bake element 3 and the broil element 4 respectively to L1. Relay 5 connects the other terminal of both heating elements to power source L2 via a thermal limit switch 6. Typically the bake element has a power rating which is roughly 75% of the broil element rating.

During normal operation the temperature in the oven is maintained within acceptable limits by cycling the relay switches. For example, energization of the broil element in the bake operating mode is typically cycled to operate at one-quarter power when the bake element is operated at full power, and in the broil mode, the bake element is switched to its open state and the broil element is operated at full power or duty cycled depending on the broil mode selected. Consequently under normal operating conditions, the maximum total power is applied in the broil mode and the oven is designed to keep the surface temperature of the oven cabinet within acceptable temperature limits under such conditions. However, an abnormal operating condition could arise in which the three relays fail closed. In this worst case condition both the bake and broil elements would be energized at full power simultaneously. Under such conditions the oven temperature may rise to a level which causes the cabinet surface temperature to exceed normal operating temperatures. The thermal limit switch 6 is mounted externally of the oven on the outer surface of the range cabinet to provide protection against such an occurrence. Switch 6 is operative to interrupt energization of the heating elements in the event the temperature of the oven cabinet proximate the switch exceeds its threshold temperature.

This arrangement works satisfactorily, however, the use of the limit switch and its associated wiring adds cost to the design. It would be desirable to provide a less costly circuit arrangement which protects against excessive temperature conditions in the event of worst case failures of the switching devices without adversely affecting heating performance.

It is therefore, a primary object of the present invention to provide an improved switching arrangement for use in self-cleaning ovens which provides reliable protection against excessive temperatures in the event of switching device failures and which uses fewer components and is less costly than arrangements known in the art.

SUMMARY OF THE INVENTION

An improved power switching arrangement is provided for a self-cleaning oven appliance of the type energized by the standard three wire domestic AC power supply, and having an oven cavity, with a bake heating element disposed proximate its bottom wall and a broil heating element disposed proximate its top wall.

The power switching circuit conventionally includes a first relay switching device which is operative when closed to electrically connect one terminal of the bake element and one terminal of the broil element to the first power line, L1. In accordance with the present invention the improvement comprises a unique arrangement of two double throw relay switching devices, each comprising a common terminal, a normally open terminal and a normally closed terminal. In a preferred form of the invention, these switches are arranged such that, one has its common terminal electrically connected to the second power line, L2, and its normally open terminal electrically connected to the other terminal of the bake element, and the other has its common terminal electrically connected to the other terminal of the broil element, its normally closed terminal electrically connected to the neutral line, N, and its normally open terminal electrically connected to the normally closed terminal of the one switching device.

The one switching device is switchable between a first operating state in which its common and normally open terminals are electrically connected thereby connecting the other terminal of the bake element to L2 to enable energization of the bake element across L1 and L2, and a second operating state in which the common and normally closed terminals are electrically connected to disconnect the bake element from the power circuit. The other switching device is switchable between a first operating state in which its common and normally closed contacts are electrically connected thereby electrically connecting the other terminal of the broil element to the neutral line to enable energization of the broil element across L1 and N, and a second operating state in which its common and normally open terminals are electrically connected to enable energization of the broil element across L1 and L2 through the normally closed and common contacts of the one switching device.

By connecting the bake and broil elements to the three wire power supply in this fashion, the bake element can be cycled and the broil element operated at one-quarter power in the bake cycle and the broil element can be operated at full power or cycled in the broil cycle, providing the same performance potential as does the prior art circuit of FIG. 1. However, both heating elements cannot be simultaneously energized at full power regardless of the failure mode of the switching circuitry. The only combination possible in this configuration for simultaneously energizing both elements at significant power levels is one in which the bake element is energized at full power across L1 and L2, and the broil element is energized at one-quarter power across L1 and N. Since in this arrangement no failure mode exists in which both heating elements can be simultaneously energized at full power, the need for a thermal limit switch to guard against excessive temperatures in the oven is eliminated.

BRIEF DESCRIPTION OF THE DRAWINGS

While the novel features of the invention are set forth with particularity in the appended claims, the invention both as to organization and content will be better understood and appreciated from the following detailed description taken in conjunction with the drawings, in which:

DESCRIPTION OF THE PREFERRED EMBODIMENT

Figure 2:
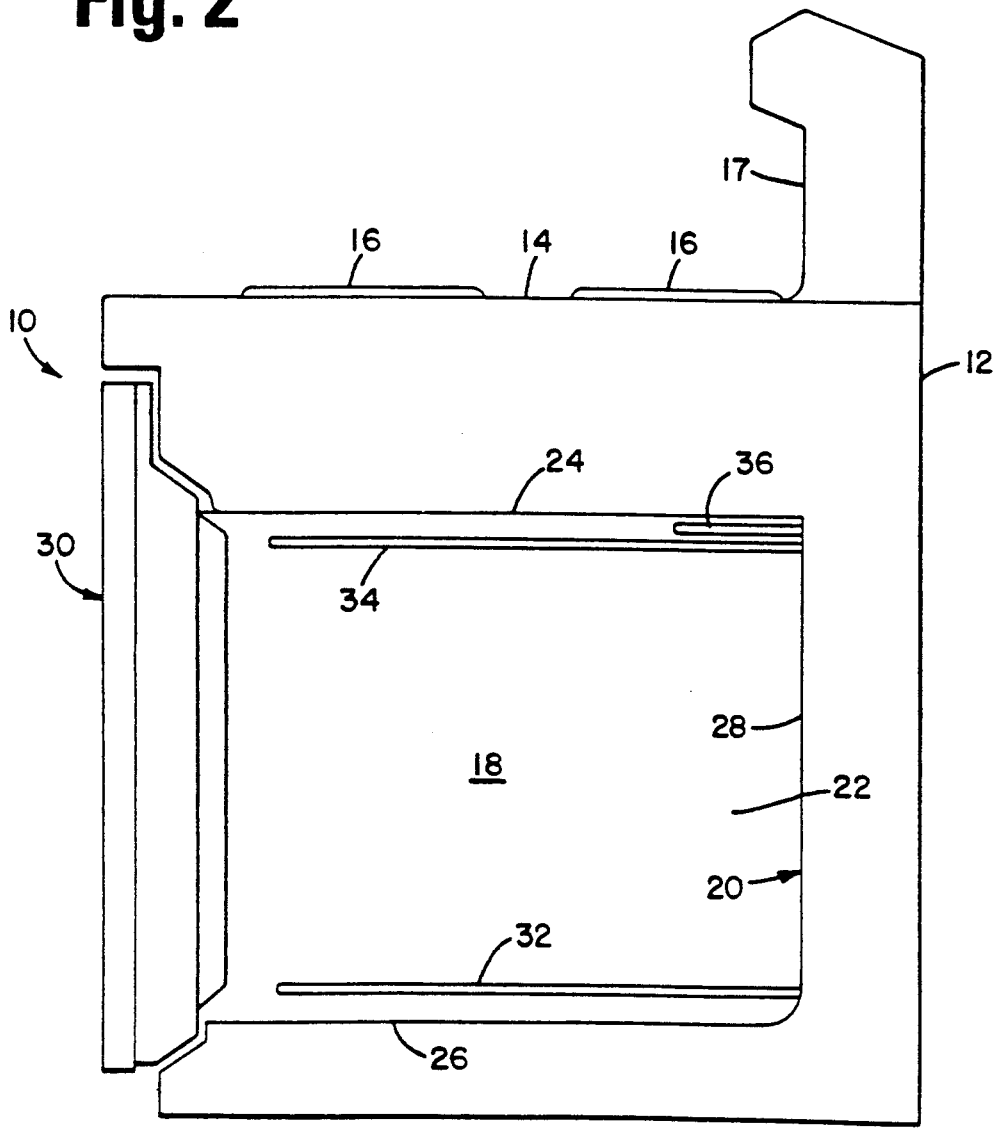
FIG. 2 is a schematic fragmentary side elevational view of an electric self-cleaning range incorporating an illustrative embodiment of the power switching arrangement of the present invention.

Referring to the drawings and more particularly to FIG. 2, there is shown for illustrative purposes a free standing electric range 10. While a free standing range is described herein, it should be understood that the invention may be applied to other oven appliances as well. The range 10 generally includes an outer cabinet 12 which includes a top cooking surface or cooktop 14 with a plurality of surface units 16. A control panel (not shown) including user actuable controls, such as control knobs or touch pads, for selecting various operating modes for the surface units and the oven, and a visual display, may be mounted behind the backsplash 17. Positioned in the cabinet 12 is an oven cavity 18 formed by a box-like oven liner 20 having vertical side walls 22, top wall 24, bottom wall 26, rear wall 28 and a front opening drop door 30. The oven cavity 18 is supplied with two electric resistance elements, a bake element 32 positioned proximate the bottom wall 26, and a broil element 34 positioned proximate to the top wall 24. In the illustrative embodiment the bake element 32 is rated at 2500 watts and the broil element 34 is rated at 3400 watts. A standard temperature probe 36 is mounted to project into the oven cavity 18.

Figure 3:
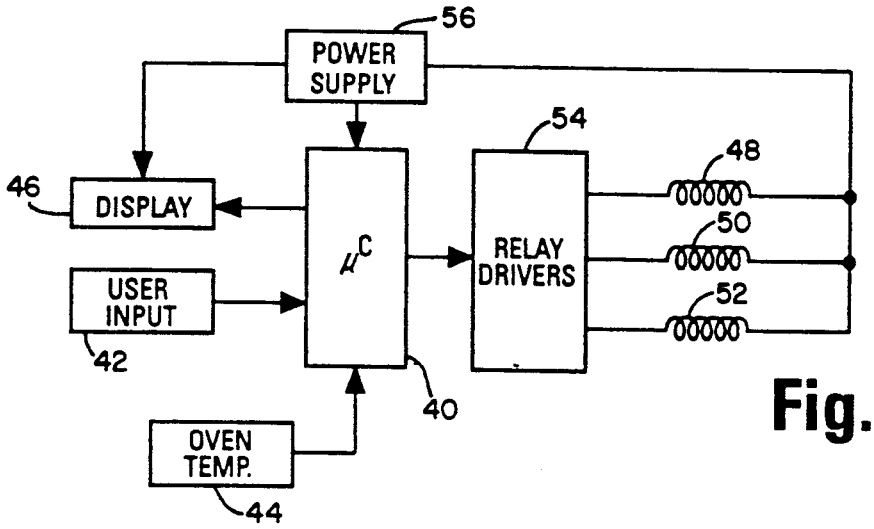
FIG. 3 is a functional block diagram of a power control circuit for the range of FIG. 2.

Operation of the oven of range 10 in various cooking modes including a bake mode, a broil mode and a cleaning mode is controlled by the microprocessor-based control circuit schematically represented in FIG. 3. The microprocessor 40 may be programmed in conventional fashion to receive input signals from the user actuable input control knobs or pads functionally represented as input means 42, representing the desired operating mode and operating temperature information, and from the oven temperature sensor circuit 44, representing the actual temperature in the oven, and to generate appropriate output signals for the visual display 46 and switching signals for the bake relay coil 48, the broil relay coil 50, and the double line break relay coil 52, via conventional relay driver circuitry 54 to control energization of the bake and broil heating elements 32 and 34, respectively. Power for the control circuit is provided by a conventional DC power supply 56.

Figure 1:
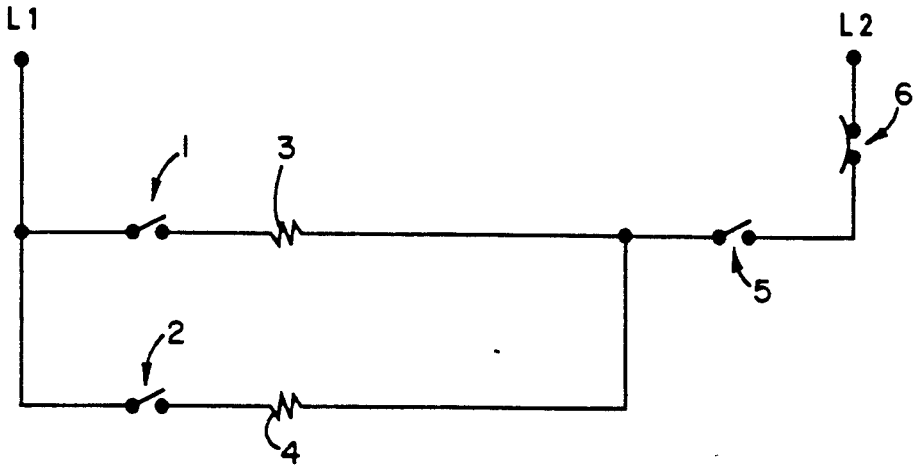
Fig. 1 PRIOR ART
FIG. 1 is a schematic circuit diagram of a portion of a prior art power switching circuit arrangement for a self-cleaning oven.

As briefly described in the Background discussion, the prior art switching arrangement illustrated in FIG. 1 is vulnerable to a worst case failure condition in which both the bake and the broil relays fail to the shorted state causing both elements to be simultaneously energized at full power, potentially resulting in excessively high oven cabinet surface temperatures. The prior art solution protects against this worst case condition by providing a thermal limit switch mounted to the external surface of the oven cabinet to interrupt energization of the heating elements should the cabinet surface temperature exceed its threshold temperature.

Figure 4:
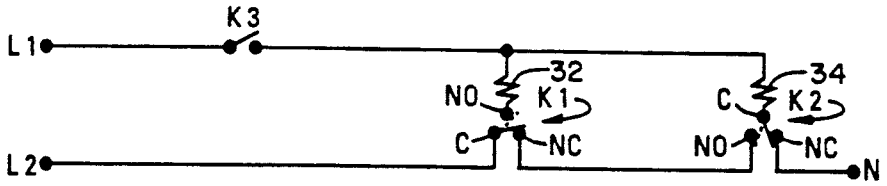
FIG. 4 is a schematic wiring diagram of the power switching circuit for the oven heating elements in the range of FIG. 2, illustratively embodying the switching arrangement of the present invention.

In accordance with the present invention an improved power switching arrangement is provided which reliably protects against abnormally high temperature conditions in the event of a worst case switching failure, while eliminating the need for the limit switch and its associated wiring. Referring now to the diagram of FIG. 4, K1, K2 and K3 represent the switching contacts operatively coupled to the bake relay coil 48, the broil relay coil 50 and the double line break relay coil 52, respectively (FIG. 3). The bake and broil relays comprising coils 48 and 50 and contacts K1 and K2 respectively, are single pole double throw relays, each having a common terminal designated C, a normally open contact terminal designated NO and a normally closed contact terminal designated NC. The terms normally open and normally closed are used in the conventional sense, i.e., the relay is in its normally closed state, closed across its normally closed terminal when its coil is de-energized and in its normally open state, closed across its normally open terminal when its relay coil is energized. Contacts K3 are closed when relay coil 52 is energized and open otherwise. L1, L2 and N refer to the standard three wire domestic 240 volt AC power supply, with a nominal 240 volts across L1 and L2 and a nominal 120 volts across L1 and neutral line, N.

In accordance with the invention one terminal of the bake element 32 and one terminal of the broil element 34 are each electrically connected to power line L1 via contacts K3. The other terminal of bake element 32 is connected to normally open terminal NO of K1. The common terminal of K1 is electrically connected to power supply line L2. The other terminal of the broil element 34 is electrically connected to the common terminal C of K2. The normally closed terminal of K2 is connected to neutral power supply line N. The normally open terminal of K2 is electrically connected to the normally closed terminal NC of K1.

The switching states for K1, K2 and K3 for the bake, broil and clean operating modes are listed in Table A.

TABLE A

| MODE | K1 | K2 | K3 | Bake Htr. | Broil Htr. |
|---|---|---|---|---|---|
| Bake | Cycle | NC | Cycle | 240 v | 120 v |
| Broil | NC | NO | Cycle | — | 240 v |
| Clean (1st cycle) | NC | NO | Cycle | — | 240 v |
| Clean (after 1st Cycle) | Cycle | NC | Cycle | 240 v | 120 v |

In the Bake mode K2 is switched to its normally closed mode and K1 and K3 are cycled to provide the desired temperature in the oven cavity. In this mode the 240 volt supply via L1 and L2 is applied to the bake element 32 to operate it at 2500 watts when K1 is in its normally open state and K3 is closed. The 120 volt supply via L1 and N is applied to the broil element 34 operating it at one-quarter power or 850 watts. Maximum power to the oven in the Bake mode is 3350 watts. In the Broil mode, K1 is switched to its normally closed state, de-energizing the bake element 32, and K2 is switched to its normally open state connecting the broil element 34 across the 240 volt supply via L1 and L2 to operate it at 3400 watts. Maximum power to the oven in the Broil mode is 3400 watts. K3 is cycled to achieve the selected broil performance.

During the first cycle of the Clean mode, consisting of the first 30 minutes of operation in that mode, the relays are operated as in the broil mode to provide high initial heat proximate the top wall of the oven to enable the smoke eliminator (not shown) to come up to operating temperature before applying high heat to the more heavily soiled bottom area of the oven. For the balance of the self-cleaning operation after this first cycle, the relays operate as in the Bake mode with cycling to achieve and maintain the high self-clean temperatures in the oven.

By interconnecting the relay contacts with the bake and broil elements in this way to couple the elements to the three wire power supply, the bake element can be cycled and the broil element operated at one-quarter power in the bake cycle, and the broil element can be operated at full power or cycled in the broil cycle, providing the same performance potential as does the prior art circuit of FIG. 1. However, both heating elements cannot be simultaneously energized at full power regardless of the failure mode of the switching circuitry. The only combination possible in this configuration for simultaneously energizing both elements at significant power levels is one in which the bake element is energized at full power across L1 and L2, and the broil element is energized at one-quarter power across L1 and N. In this operating state the power to the oven is 3350 watts.

The only other combination of switching states which results in simultaneous energization of the heating elements occurs when K1 is in its normally open state and K2 is in its normally closed state with K3 open. In this case bake element 32 and broil element 34 are connected in series between L2 and N. However, the total power output to the oven for this combination would less than 400 watts.

Thus by the arrangement of the present invention the maximum power output to the oven is limited to 3400 watts which occurs when the broil element 34 is operated at full power. By contrast, the worst case condition of the prior art circuit in which both elements are operating at full power results in a maximum power to the oven of 5900 watts. By limiting the maximum power to 3400 watts, the need for the external thermal limit switch of the prior art is eliminated.

Figure 5A:
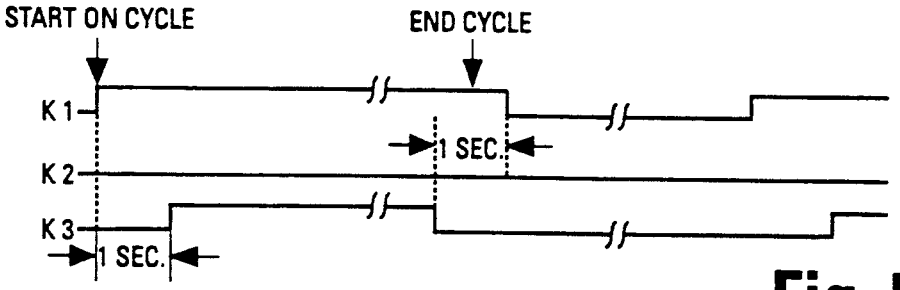
FIGS. 5A and 5B illustrate the relay switching sequences for the relays of FIG. 4 for operation in the bake and broil operating modes, respectively.
Figure 5B:
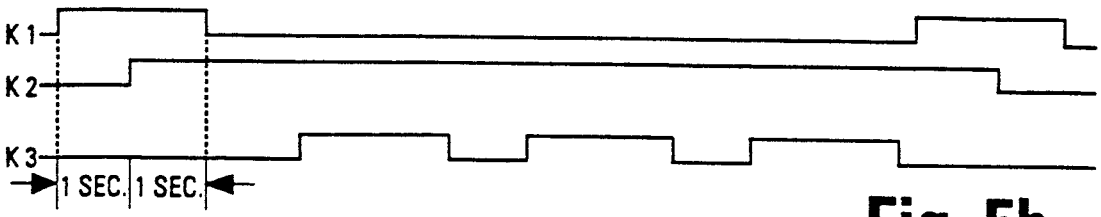

Representative switching sequences for initiating and terminating cycles in the Bake and Broil operating modes to minimize contact arcing for contacts K1 and K2 are illustrated in FIGS. 5A and 5B, respectively. As shown in FIG. 5A, each power on cycle in the Bake mode is initiated with K3 in its open state, K2 in its normally closed state and K1 in its normally closed state. The cycle is initiated by initially switching K1 to its normally open state, followed one second later by closing K3. The power on cycle is terminated by reversing this sequence. K3 is switched open, followed one second later by switching K1 to its normally closed state. The duration and frequency of the power on cycles in the Bake mode are determined by the selected bake temperature and the sensed oven temperature in conventional fashion.

In the Broil mode (FIG. 5B) the power on cycle is initiated by initially switching K1 to its normally open state. One second later, K2 is switched to its normally open state. After a delay of one more second K1 is switched to its normally closed state. During this transition period K3 remains in its open state. Beginning one second after K1 returns to its normally closed state, K3 is closed. Thereafter K3 is cycled at a duty cycle rate associated with the selected broil power setting. The Broil cycle is terminated by opening K3, switching K1 to its normally open state, switching K2 to its normally closed state, and returning K1 to its normally closed state, with a one second delay interposed between each step of the sequence. The switching sequence for the first cycle of the Clean mode is initiated and terminated in the same manner as for the Broil mode. Thereafter for the balance of the Clean mode, switching is accomplished as in the Bake mode.

While a specific embodiment of the present invention has been illustrated and described herein, it is realized that modifications and changes will occur to those skilled in the art to which the invention pertains. It is therefore to be understood that the appended claims are intended to cover all such modifications and changes as fall within the true spirit and scope of the invention.

I claim:

1. In a power switching circuit arrangement for an oven appliance of the type including a first power line, a second power line and a neutral line for connection to an external standard three wire AC power supply, and having an oven cavity, and first and second heating elements for heating the cavity, each heating element having two terminals, one terminal of the first heating element and one terminal of the second heating element being electrically coupled to the first power line, the improvement comprising:

first and second switching devices each selectively switchable between first and second operating states;

said first switching device being operative in its first state to connect the other terminal of the first heating element to the second power line to enable energization of the first heating element via the first and second power lines and to disconnect the other terminal of the second heating element from the second power line to prevent energization of the second heating element via the first and second power lines, and in its second state to disconnect the other terminal of the first heating element from the second power line to prevent energization of the first heating element;

said second switching device being operative in its first state to electrically connect the other terminal of the second heating element to the neutral line to enable energization of the second heating element via the first power line and the neutral line, and in its second state to disconnect the other terminal of the second heating element from the neutral line;

said first and second switching devices being operatively interconnected such that when each is in its second state, the other terminal of the second heating element is electrically connected to the second power line to enable energization of the second heating element via the first and second power lines, whereby simultaneous energization of the first and second heating elements via the first and second power lines is prevented.

2. The improvement of claim 1 wherein each of said first and second switching devices comprise a single pole double throw relay switch.

3. An improved power switching circuit arrangement for an oven appliance of the type including a first power line, a second power line and a neutral line for connection to an external standard three wire AC power supply, and having an oven cavity, a first heating element disposed proximate the bottom wall of the oven cavity and a second heating element disposed proximate the top wall of the oven cavity, each heating element including two terminals, and a first relay switching device operative when closed to electrically connect one terminal of the first heating element and one terminal of the second heating element to the first power line, the improvement comprising:

second and third relay switching devices each comprising a first terminal, a second terminal and a third terminal;

said second switching device having its first terminal electrically connected to the second power line, and its second terminal electrically connected to the other terminal of the first heating element;

said third switching device having its first terminal electrically connected to the other terminal of the second heating element, its third terminal electrically connected to the neutral line and its second terminal electrically connected to said third terminal of said second switching device;

said second switching device being switchable between a first operating state in which its first and second terminals are electrically connected thereby connecting the other terminal of the first heating element to the second power line to enable energization of the first heating element via the first and second power lines and disconnecting the other terminal of the second heating element from the second power line to prevent energization of the second heating element via the first and second power lines, and a second operating state in which said first and third terminals are electrically connected preventing energization of the first terminal element;

said third switching device being switchable between a first operating state in which its first and third contacts are electrically connected thereby electrically connecting the other terminal of the second heating element to the neutral line to enable energization of the second heating element via the first power line and the neutral line, and a second operating state in which its first and second terminals are electrically connected, to enable energization of the second heating element via the first and second power lines.

4. An improved a power switching circuit arrangement for an oven appliance of the type including a first power line a second power line and a neutral line for connection to an external standard three wire AC power supply, and having an oven cavity, a bake heating element disposed proximate the bottom wall of the oven cavity and a broil heating element disposed proximate the top wall of the oven cavity, each heating element including two terminals, and a first relay switching device operative when closed to electrically connect one terminal of the bake heating element and one terminal of the broil heating element to the first power line, the improvement comprising:

second and third relay switching devices each comprising a common terminal, a normally open terminal and a normally closed terminal;

said second switching device having its common terminal electrically connected to the second power line, and its normally open terminal electrically connected to the other terminal of the brake heating element;

said third switching device having its common terminal electrically connected to the other terminal of the broil heating element, its normally closed terminal electrically connected to the neutral line and its normally open terminal electrically connected to said normally closed terminal of said second switching device;

said second switching device being switchable between a first operating state in which its common and normally open terminals are electrically connected thereby connecting the other terminal of the bake heating element to the second power line to enable energization of the bake heating element via the first and second power lines and disconnecting the other terminal of the broil element from the second power line to prevent energization of the broil heating element via the first and second power lines, and a second operating state in which said common and normally closed terminals are electrically connected preventing energization of the bake heating element and enabling energization of the broil element via the first and second power lines;

said third switching device being switchable between a first operating state in which its common and normally closed contacts are electrically connected thereby electrically connecting the other terminal of the broil heating element to the neutral line to enable energization of the broil heating element via the first power line and the neutral line, and a second operating state in which its common and normally open terminals are electrically connected, to enable energization of the broil heating element via the first and second power lines.

* * * * *